United States Patent [19]

Segoshi

[11] Patent Number: 4,868,726

[45] Date of Patent: Sep. 19, 1989

[54] HEADLAMPS

[75] Inventor: Toru Segoshi, Yokohama, Japan

[73] Assignee: Nissan Motor Co., Ltd., Japan

[21] Appl. No.: 317,076

[22] Filed: Feb. 28, 1989

Related U.S. Application Data

[63] Continuation of Ser. No. 71,066, Jul. 8, 1987, abandoned.

[30] Foreign Application Priority Data

Jul. 21, 1986 [JP] Japan ..... 61-110625

[51] Int. Cl.[4] ..... F21V 13/14

[52] U.S. Cl. ..... 362/308; 362/61; 362/268; 362/351

[58] Field of Search ..... 362/61, 268, 307, 308, 362/311, 351, 355, 328, 343

[56] References Cited

U.S. PATENT DOCUMENTS 4,562,519 12/1985 Deves ..... 362/308

FOREIGN PATENT DOCUMENTS 149570 7/1985 European Pat. Off. ..... 362/351

OTHER PUBLICATIONS

Development of Ellipsoidal Headlamps For Motor Vehicle Lighting pp. 621-625 (1986).

*Primary Examiner*—Martin P. Schwadron
*Assistant Examiner*—Allen J. Flanigan
*Attorney, Agent, or Firm*—Leydig, Voit & Mayer

[57] ABSTRACT

A blind is disposed ahead of a reflector to intercept light of a low-beam bulb to prevent dazzle or glare to oncoming traffic. At least a portion of the blind is made of a translucent material having a low translucency such as translucent ceramics, ground glass, or the like. The blind may be partially coated with a black paint so as to have a translucent portion extending along an upper edge and an opaque portion coated with the paint.

1 Claim, 3 Drawing Sheets

HEADLAMPS

BACKGROUND OF THE INVENTION

This application is a continuation of application Ser. No. 071,066 filed July 8, 1987, now abandoned.

1. Field of the Invention

The present invention relates in general to headlamps for automotive vehicles and more particularly to a headlamp of the kind having a blind disposed ahead of a reflector for intercepting part of reflected light rays in order to prevent dazzle or glare to oncoming traffic.

2. Description of the Prior Art

Automobiles have high-beam and low-beam headlamps. Most of the driving in cities and on busy highways is done using low beams. High beam is only used when there is no traffic in front of the vehicle An example of a prior art headlamp operative to produce high and low beams is disclosed in Japanese Provisional Utility Model Publication No. 59-31707 and also shown in FIG. 8. The headlamp has an optical axis 1, an ellipsoidal reflector 2 arranged so as to have first and second focal points 3, 5 on the optical axis 1, a low-beam bulb or light source 4 at the first focal point 3, a blind 6 near the second focal point 5 and a lens 7 having a focal point coinciding with the second focal point 5 of the reflector 2. The blind 6 is made of an opaque material and disposed below the optical axis 1 in such a way as to have a horizontal upper edge joining the optical axis 1 though the upper edge is partly cut away so as to slant downward.

With the above arrangement, when the low beam is used the light of the bulb 4 is reflected by the reflector 2 so as to intersect the optical axis 1 at the second focal point 5 on the way it emerges from the reflector 2 and be directed downward of the optical axis 1, whilst the light of the bulb 4 impinging upon the lower half of the reflector 2 is intercepted by the blind 6, whereby to produce such a light distribution pattern $P_1$ having a nearly upper half cut-away portion as shown in FIG. 9.

While the above described headlamp is effective for preventing dazzle or glare to oncoming traffic, it encounters a problem of insufficient distance visibility since it sacrifices the long-range lighting to preventing dazzle or glare to oncoming traffic.

SUMMARY OF THE INVENTION

In accordance with the present invention, there is provided a novel and improved headlamp which comprises a reflector and a blind disposed ahead of the reflector for intercepting light emerging from the reflector. The above structure may follow the conventional fashion.

In accordance with the present invention, at least a portion of the blind is made of a translucent material having a low translucency.

In one embodiment, the blind is entirely made of a translucent material.

In another embodiment, the blind is partially coated with a paint so as to have a translucent portion extending along the upper edge of the blind and an opaque portion coated with the paint.

In a further embodiment, the blind is provided with an intermediate portion intermediate between the translucent portion and the opaque portion. The intermediate portion is coated with a paint in such a way as to shade off from the opaque portion to the translucent portion.

The above structure is quite effective for overcoming the above noted disadvantage or shortcoming inherent in the prior art device.

It is accordingly an object of the present invention to provide a novel and improved headlamp for an automotive vehicle which can provide a good distance visibility while at the same time can assuredly prevent dazzle or glare to oncoming traffic.

It is another object of the present invention to provide a novel and improved headlamp of the above described character which can improve long-range lighting without causing dazzle or glare to oncoming traffic.

It is a further object of the present invention to provide a novel and improved headlamp of the above described character which is quite useful and desirable from a point of view of safe driving.

DESCRIPTION OF THE PREFERRED EMBODIMENTS

Figure 1:
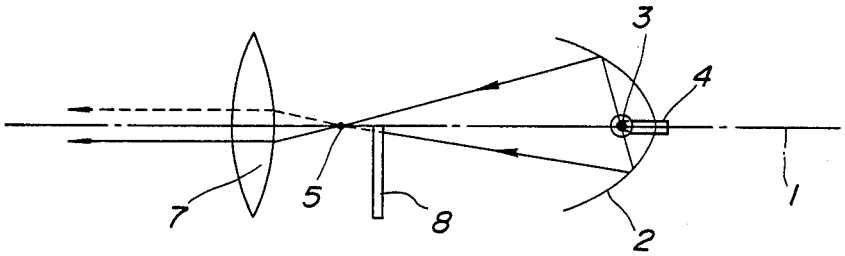
FIG. 1 is a diaramatic view of a low-beam system of a headlamp according to an embodiment of the present invention.
Figure 2:
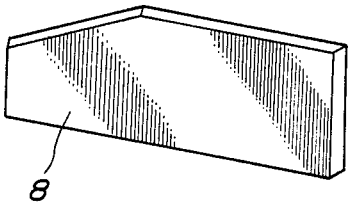
FIG. 2 is a perspective view of a blind employed in the low-beam system of the headlamp of FIG. 1.
Figure 8:
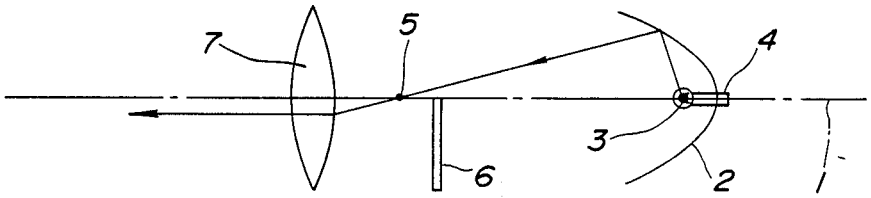
FIG. 8 (Prior Art)
FIG. 8 is a diagramatic view of a low-beam system of a prior art headlamp.
Figure 9:
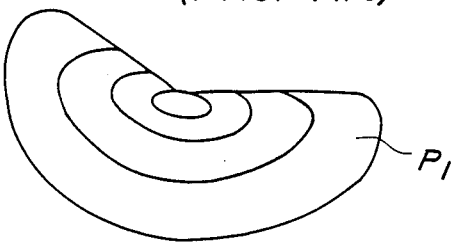
FIG. 9 (Prior Art)
FIG. 9 is a view of a light distribution pattern effected by the low beam system of the headlamp of FIG. 8.

Referring first to FIGS. 1 and 2, in which elements or parts identical with those of the prior art headlamp of FIG. 8 are designated by the same reference characters, a headlamp according to an embodiment of the present invention is shown as comprising an optical axis 1, an ellipsoidal reflector 2 arranged so as to have first and second focal points 3, 5 on the optical axis 1, a low-beam bulb or light source 4 at the first focal point 3, a lens 7 having a focal point coinciding with the second focal point 5 of the reflector 2 and a blind 8 near the second focal point 5 of the reflector 2 and located between the bulb 4 and the second focal point 5. The blind 8 is nearly rectangular and disposed below the optical axis 1 in such a way as to have a horizontal upper edge joining the optical axis 1 though the upper edge is partly cut away in such a way as to have a portion slanting downward toward one lateral end of the blind 8 as shown in FIG. 2. The above structure may substantially follow the conventional fashion.

In accordance with the present invention, the blind 8 is made of a translucent material having a low translucency such as translucent ceramics, ground glass or the like, instead of being made of an opaque material.

Figure 3:
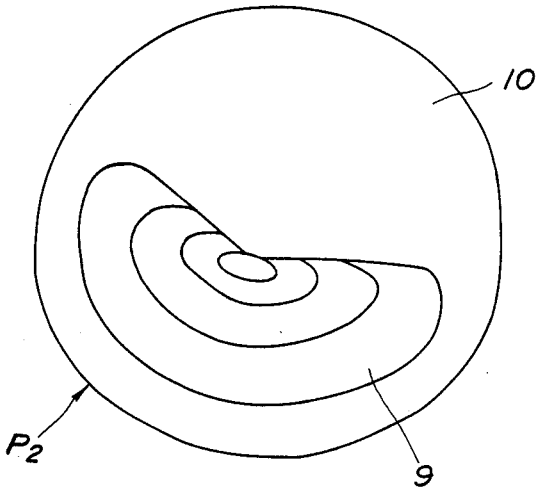
FIG. 3 is a view of a light distribution pattern effected by the low-beam system of the headlamp of FIG. 1.

The blind 8 permits a reduced amount of light to pass therethrough. For this sake, the light of the bulb 4 impinging upon the lower half of the reflector 2 passes through the blind 8 and is so distributed, as dim illumination, as to constitute the nearly upper half part of the light distribution pattern. On the other hand, the light of the bulb 4 impinging upon the upper half of the reflector 2 intersects the optical axis 1 at the second focal point 5 and is so distributed, as bright illumination, as to constitute the nearly lower half part of the light distribution pattern. By the use of the blind 8, a light distribution pattern $P_2$ shown in FIG. 3 is obtained. The light distribution pattern $P_2$ has a nearly lower half part 9 providing bright illumination and a nearly upper half part 10 providing weak, dim illumination. The upper half part 10 is cut away and not provided in case of the prior art system. The brightness of the upper half part 10 is weak enough not to cause dazzle or glare to oncoming traffic but improves long-range lighting to provide improved visibility.

Figure 4:
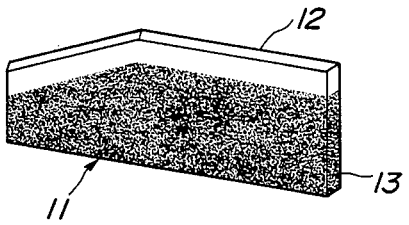
FIGS. 4 to 6 are views similar to FIG. 2 but showing variants of the blind to be employed in the low-beam system of the headlamp of FIG. 1.
Figure 5:
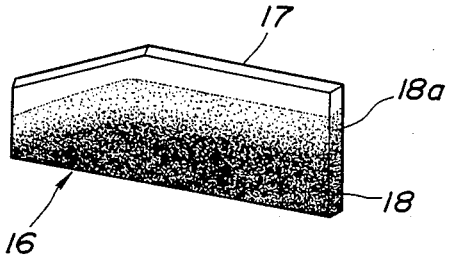
Figure 6:
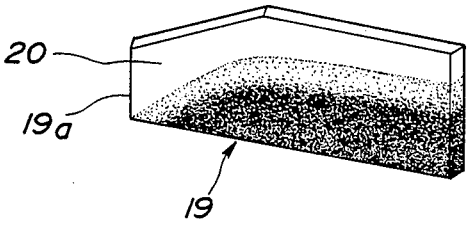
Figure 7:
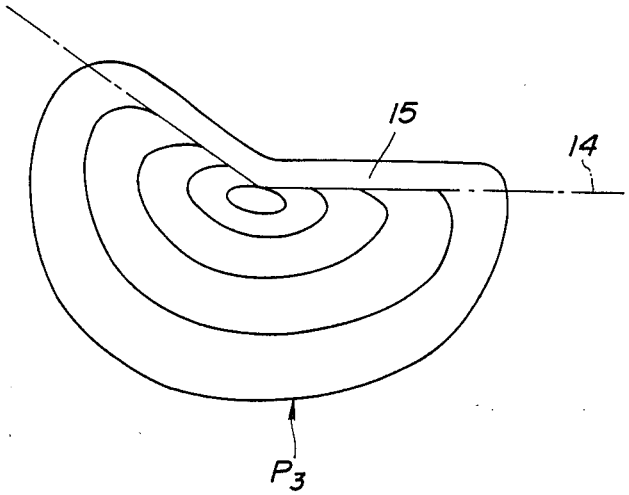
FIG. 7 is a view of a light distribution pattern effected by the low-beam system of the headlamp equipped with the blind of FIG. 4.

FIGS. 4 to 6 show various blinds according to variants of the present invention. The blind 11 shown in FIG. 4 is made of a translucent material having a low translucency similarly to the blind 8 of the previous embodiment and is coated with a black paint except an upper portion extending along the upper edge so that the blind 11 includes a translucent portion 12 extending along the upper edge and an opaque portion 13 coated with the paint. With this variant, the blind 11 permits the light emerging from the reflector 2 to pass through the translucent portion 12 only and therefore produce such a light distribution pattern $P_3$ including a portion 15 located above the cut-off line 14 and operative to produce weak illumination that is weak enough not to cause dazzle or glare to oncoming traffic. The blind 16 shown in FIG. 5 includes a translucent portion 17, an opaque portion 18 and an intermediate portion 18*a* intermediate between the opaque portion 18 and the translucent portion 17. The intermediate portion 18*a* is coated with a black paint in such a way as to graduate or shade off from the opaque portion 18 to the translucent portion 17. The blind 19 in FIG. 6 has a translucent portion 20 adapted to extend throughout the overall height of the blind 19 at one lateral end 19*a* nearer to the upper slanting edge.

From the foregoing, it will be understood that according to the present invention at least a portion of the blind is made of a translucent material having a low translucency for thereby permitting a reduced amount of light to pass through the blind, which light permitted to pass is weak enough not to cause dazzle or glare to oncoming traffic, thus making it possible to improve the visibility, particularly the distance visibility while assuredly preventing dazzle or glare to oncoming traffic.

What is claimed is:

1. A headlamp for an automotive vehicle comprising:

an optical axis;

an ellipsoidal reflector disposed so as to have first and second focal points on said optical axis said second focal point being located further away from said reflector than said first focal point;

a low-beam light source at said first focal points; a lens having a focal point coinciding with said second focal point; and a blind located between said light source and said second focal point at position closer to said second focal point;

said blind comprising an uncoated plate of uniform thickness made of a translucent material of uniform optical translucence to increase light distribution so as to improve long-range lighting and visibility.

* * * * *